US010045639B2

(12) United States Patent
Johnson et al.

(10) Patent No.: US 10,045,639 B2
(45) Date of Patent: Aug. 14, 2018

(54) DISPLAY RISER ASSEMBLY

(71) Applicant: Target Brands, Inc., Minneapolis, MN (US)

(72) Inventors: Jason W. Johnson, Wayzata, MN (US); Erin L. Zobel, Minneapolis, MN (US)

(73) Assignee: Target Brands, Inc., Minneapolis, MN (US)

( * ) Notice: Subject to any disclaimer, the term of this patent is extended or adjusted under 35 U.S.C. 154(b) by 0 days.

(21) Appl. No.: 15/284,686

(22) Filed: Oct. 4, 2016

(65) Prior Publication Data

US 2018/0092470 A1 Apr. 5, 2018

(51) Int. Cl.

| | |
|---|---|
| ***A47F 5/00*** | (2006.01) |
| ***A47F 5/08*** | (2006.01) |
| ***A47F 7/00*** | (2006.01) |
| ***A47B 97/00*** | (2006.01) |

(52) U.S. Cl.

CPC ..... *A47F 5/0043* (2013.01); *A47B 97/00* (2013.01); *A47F 5/08* (2013.01); *A47F 7/00* (2013.01)

(58) Field of Classification Search

CPC ..... A47B 97/00; A47B 96/027; A47B 96/028; G09F 3/04; G09F 5/00; A47F 5/0043; A47F 5/08; A47F 5/0025; A47F 5/103; A47F 5/16; A47F 5/0018; A47F 5/10; A47F 5/0062; A47F 7/00; A47F 7/286; A47F 7/0028; A47F 7/28; A47F 7/281; A47F 7/283; A47F 7/285; A47F 7/288

USPC ..... 211/119.003

See application file for complete search history.

(56) References Cited

U.S. PATENT DOCUMENTS

| | | | | | |
|---|---|---|---|---|---|
| 1,739,730 | A | * | 12/1929 | Orthwine | A47F 5/0062 206/459.5 |
| 1,895,283 | A | | 1/1933 | Friedemann | |
| 1,934,846 | A | * | 11/1933 | Ludwig | A47F 5/112 108/101 |
| 2,263,837 | A | | 11/1941 | Erickson | |
| 2,362,367 | A | * | 11/1944 | Freeman | G09F 5/02 211/150 |
| D179,268 | S | | 11/1956 | Schaiper | |
| 2,857,694 | A | * | 10/1958 | Abrams | A47F 5/00 40/124.01 |
| 2,998,107 | A | | 8/1961 | Zimmerla | |
| 3,081,718 | A | | 3/1963 | Shaffner | |
| 3,169,810 | A | | 2/1965 | Levy et al. | |
| 3,394,973 | A | | 7/1968 | Scott | |

(Continued)

*Primary Examiner* — Patrick D Hawn

(74) *Attorney, Agent, or Firm* — Leanne Taveggia Farrell; Westman, Champlin & Koehler, P.A.

(57) ABSTRACT

A display riser assembly includes at least one riser positioned on a back portion of a top surface of a display shelf and at least one paddle mounted to the at least one riser. The at least one riser includes a top panel, a front panel and two side panels located on either ends of the top panel and the front panel. The top panel includes a plurality of spaced apart through slots. The at least one paddle includes at least one planar display section that is horizontally oriented, at least one planar extension section that extends backwardly from the at least one display section and is inserted into one of the plurality of through slots so that the at least one display section is cantilevered forward from the riser and located above the top surface of the display shelf. Each riser supports a plurality of display sections.

16 Claims, 8 Drawing Sheets

(56) References Cited

U.S. PATENT DOCUMENTS 4,687,108 A * 8/1987 Kernodle, Sr. ..... A47F 7/285 211/74
4,716,841 A 1/1988 Suttles
4,782,957 A * 11/1988 Kernodle, Sr. ..... A47B 13/16 211/69.5
5,078,280 A * 1/1992 Nordeen ..... B25H 5/00 211/119.003
5,096,272 A * 3/1992 Belokin, Jr. ..... A47F 3/06 211/90.01
5,312,000 A * 5/1994 Bass ..... A47F 7/286 211/4
5,314,081 A 5/1994 Carroll
5,379,976 A 1/1995 DeGirolamo
5,390,998 A * 2/1995 Friedman ..... A47F 3/001 312/117
5,464,105 A 11/1995 Mandeltort
5,472,103 A * 12/1995 Merl ..... A47B 47/022 211/187
5,673,801 A * 10/1997 Markson ..... A47F 1/126 211/184
5,711,435 A * 1/1998 Morison ..... A47F 5/08 211/90.01
6,105,796 A * 8/2000 Buchanan ..... A47F 9/04 186/59
6,161,708 A * 12/2000 Myler ..... A47F 5/0031 211/106
6,561,365 B2 5/2003 Bustos
6,629,617 B2 * 10/2003 Osawa ..... A47F 5/16 211/119.003
D524,576 S 7/2006 Nomoto
D529,313 S 10/2006 Nomoto
7,160,005 B1 1/2007 Pape et al.
7,234,604 B2 6/2007 Eisele
7,287,652 B2 * 10/2007 Scholen ..... A47F 5/0846 211/26
D608,183 S 1/2010 Meyer et al.
8,056,740 B2 * 11/2011 Weshler ..... A47F 7/024 211/119.003
8,079,478 B2 * 12/2011 Short ..... A47F 7/286 206/734
8,087,522 B2 1/2012 Stafford et al.
8,186,522 B2 * 5/2012 Weshler ..... A47F 7/024 211/119.003
8,256,628 B2 * 9/2012 Stafford ..... A47F 5/0025 108/108
8,579,125 B2 * 11/2013 Trinh ..... A47F 7/286 206/560
8,763,819 B2 * 7/2014 Theisen ..... A47F 5/0025 211/119.003
8,919,264 B1 * 12/2014 Lager ..... A47B 9/04 108/108
8,925,745 B2 * 1/2015 Theisen ..... F21V 33/00 211/10
8,967,399 B2 * 3/2015 Hawkins ..... A47F 5/10 211/126.2
9,022,330 B2 5/2015 Heersink
9,060,625 B2 * 6/2015 Theisen ..... A47F 5/0025
9,277,832 B2 * 3/2016 Theisen ..... A47F 5/0025
9,433,290 B1 * 9/2016 Davis ..... A47B 96/025
9,480,334 B2 * 11/2016 Theisen ..... A47F 5/08
9,538,859 B1 * 1/2017 Johnson ..... A47F 5/0043
9,603,467 B2 * 3/2017 Lockwood ..... A47F 1/126
9,615,677 B2 * 4/2017 Trinh ..... A47F 5/0087
9,657,890 B2 * 5/2017 Botello ..... F16M 13/02
9,700,155 B1 * 7/2017 Theisen ..... A47F 3/145
9,788,669 B1 * 10/2017 Denby ..... A47F 7/024
2005/0139560 A1 * 6/2005 Whiteside ..... A47B 57/586 211/119.003
2007/0056878 A1 * 3/2007 Walsh ..... A45D 40/0087 206/581
2009/0294392 A1 * 12/2009 Stafford ..... A47F 5/0025 211/153
2011/0006072 A1 * 1/2011 Short ..... A45D 40/0087 220/737
2012/0084961 A1 * 4/2012 Stafford ..... A47F 5/0025 29/428
2013/0081311 A1 * 4/2013 Luo ..... A47F 5/0025 40/584
2013/0213911 A1 * 8/2013 Theisen ..... A47F 5/0025 211/59.4
2014/0251931 A1 * 9/2014 Theisen ..... A47F 5/0025 211/84
2015/0068086 A1 * 3/2015 Theisen ..... G09F 3/204 40/661.06
2015/0076093 A1 * 3/2015 Theisen ..... F21V 33/00 211/85.26
2015/0243193 A1 * 8/2015 Trinh ..... A47F 5/0087 211/150
2017/0215603 A1 * 8/2017 Johnson ..... A47F 5/0056

* cited by examiner

DISPLAY RISER ASSEMBLY

BACKGROUND

Retail stores use a variety of display fixtures to present products to customers for purchase. These display fixtures can support the product, indicate the product price, include signage for highlighting the product and/or include structures that hold samples of the product. Exemplary display structures include shelves, trays, racks, peg hooks and other similar structures.

The discussion above is merely provided for general background information and is not intended to be used as an aid in determining the scope of the claimed subject matter.

SUMMARY

A display riser assembly includes at least one riser positioned on a back portion of a top surface of a display shelf. The at least one riser including a top panel and a front panel that positions the top panel above the display shelf. At least one paddle is mounted to the at least one riser and includes at least one planar display section that is horizontally oriented. The at least one paddle is cantilevered forward from the top panel of the riser and the display section is located above the top surface of the display shelf at substantially the same height as a height that the top panel of the at least one riser is located from the top surface of the display shelf. The at least one display section increased display space on the display shelf.

A display riser assembly includes at least one box support positioned on a back portion of a top surface of a display shelf and including a top panel, a front panel and two side panels located on either ends of the top panel and the front panel. The top panel includes a plurality of spaced apart through slots. At least one paddle includes at least one planar display section that is horizontally oriented, at least one planar extension section that extends backwardly from the at least one display section and is inserted into one of the plurality of through slots so that the at least one display section is cantilevered forward from the box support and located above the top surface of the display shelf. Each box support supports a plurality of display sections.

A method of displaying products on a display shelf is provided. At least one riser is placed on a back portion of a top surface of a display shelf. The at least one riser includes a top panel having a plurality of spaced apart slots and a front panel that positions the top panel above the display shelf. At least one planar extension section of at least one paddle having at least one planar display section is inserted into one of the plurality of spaced apart slots in the top panel so that the at least one planar display section extends outwardly from the at least one riser and is located a distance above the top surface of the display shelf that is substantially similar to a distance that the top panel is above the top surface of the display shelf. Products on the top surface of the display shelf are displayed adjacent to and partially underneath the at least one planar display section and display a product on the at least one planar display section.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the background.

DETAILED DESCRIPTION

A display riser assembly is described herein that is placed on a back portion of a display shelf to aid in supporting sample products, such as floor cleaners, in a retail store. The display riser assembly in combination with a top surface of a display shelf supports and displays sample products in a way that allows for more floor cleaners to be displayed along the same shelf than was previously possible. Directly underneath the display shelf supporting floor cleaner samples are packages of product so that after the customer has inspected the sample products, the customer can place the matching package into their cart for purchase.

Figure 1:
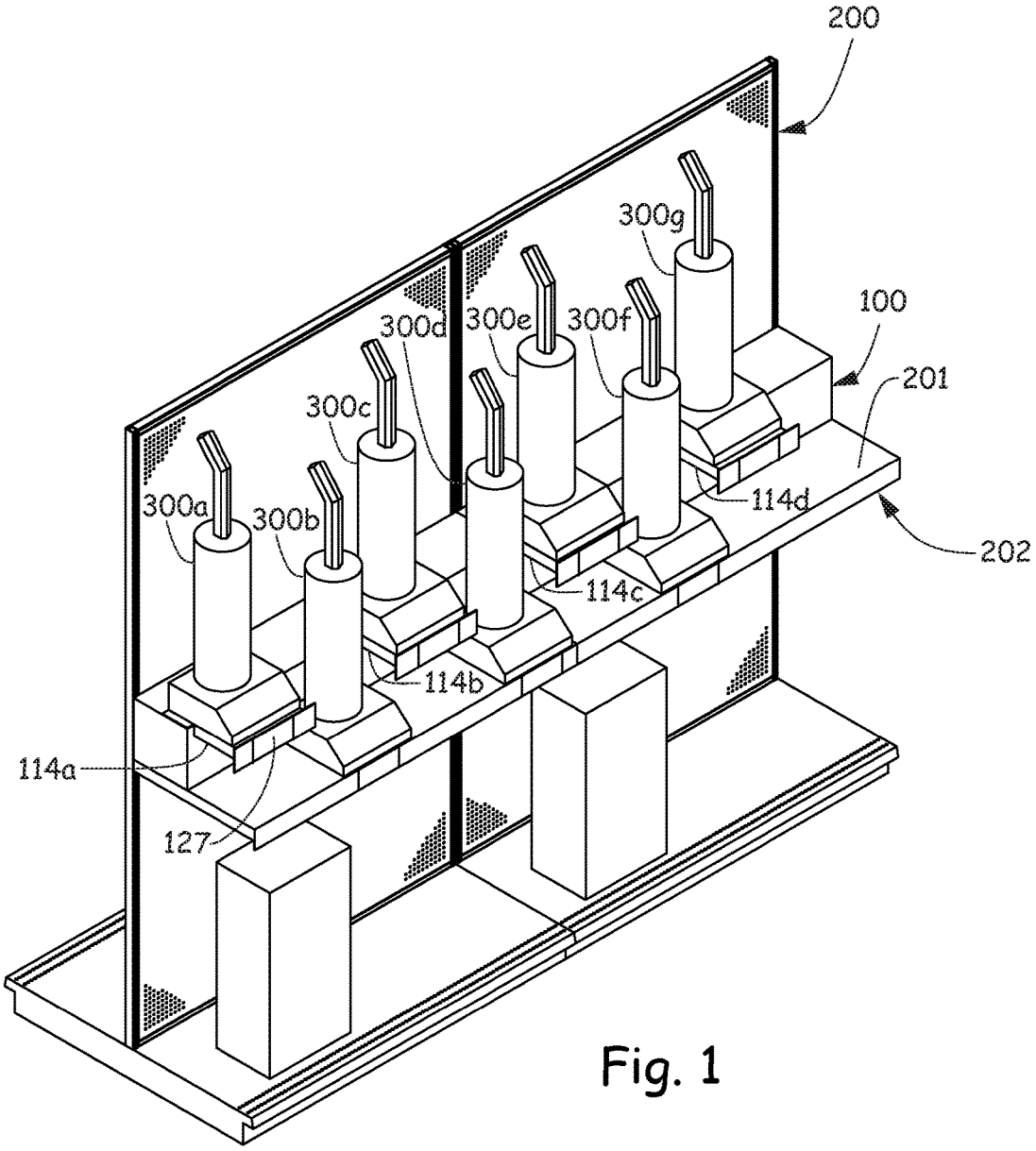
FIG. 1 is a perspective view of a display riser assembly located on a display shelf of a gondola display unit displaying sample products according to one embodiment.

FIG. 1 is a perspective view of a display riser assembly 100 located on a back portion of a top surface 201 of a display shelf 202 attached to a gondola display unit 200 displaying sample products 300*a-i* according to one embodiment. Floor cleaners include wide bases that establish a width of a cleaning path. In a vacuum cleaner, for example, the base includes a nozzle and an agitator. Floor cleaners also include upright portions, which extend upwardly from the wide bases and include handles. In general, the base of the floor cleaner is wider than a width of the upright portion so that the base provides a relatively large cleaning path. When displaying floor cleaners side-by-side on a shelf, the number of floor cleaners that can be displayed is limited by the width of the bases because it is the bases that are resting on the top surface of a shelf. As will be described herein, display riser assembly 100 allows more floor cleaners to be displayed on the same shelf.

Figure 2:
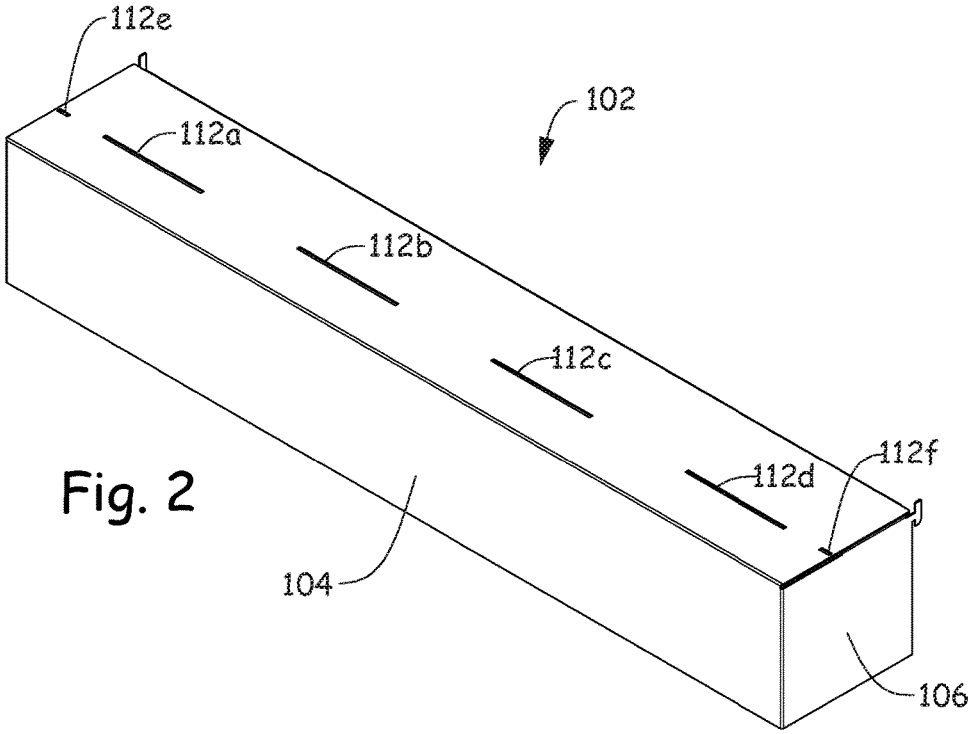
FIG. 2 is a perspective view of a riser of the display riser assembly illustrated in FIG. 1.
Figure 5:
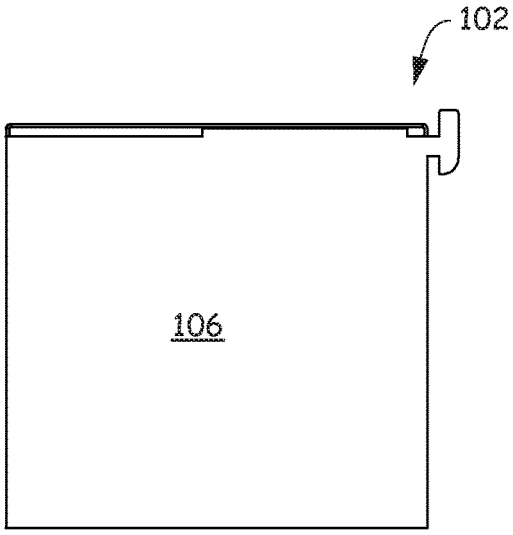
FIG. 5 is a right side view of the riser of FIG. 2.
Figure 6:
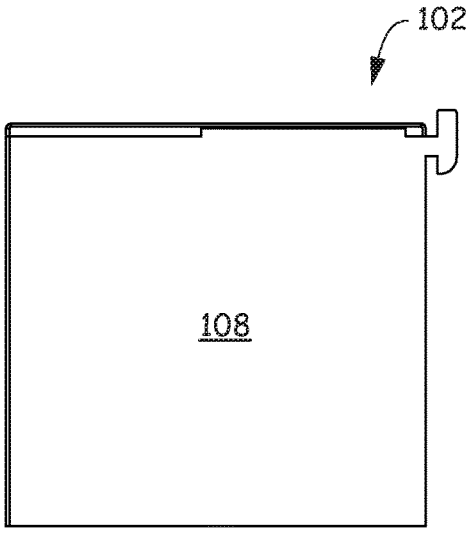
FIG. 6 is a section view of the riser of FIG. 3 taken through the section line in FIG. 5.
Figure 3:
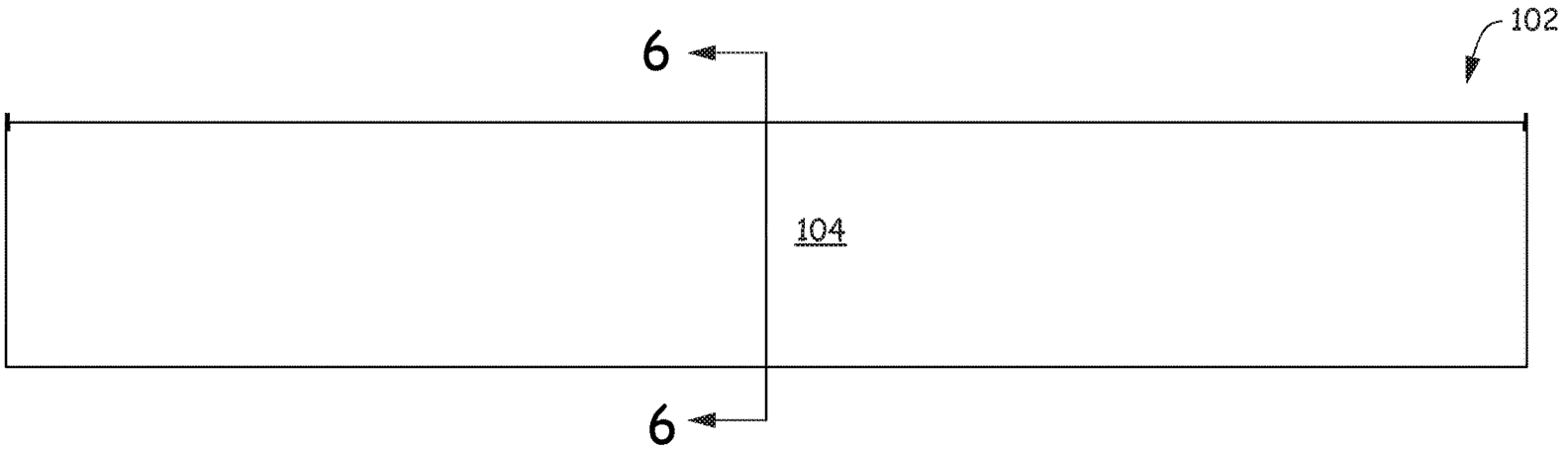
FIG. 3 is a front view of the riser of FIG. 2.
Figure 4:
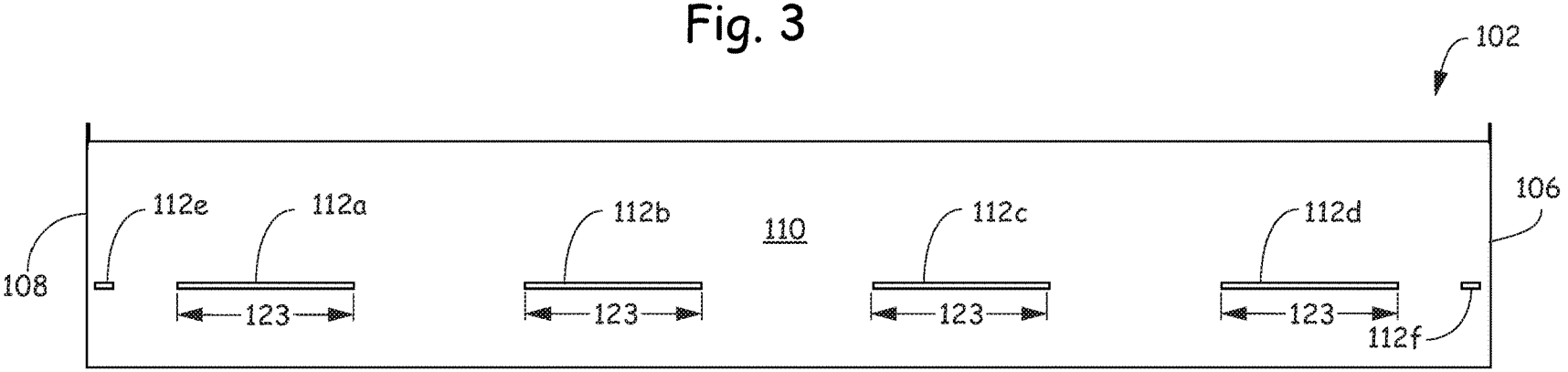
FIG. 4 is a top view of the riser of FIG. 2.

FIG. 2 is a perspective view of a riser or box support 102 of display riser assembly 100. Riser or box support 102 is positioned on the back portion of top surface 201 of display shelf 202. FIG. 3 is a front view, FIG. 4 is a top view, FIG. 5 is a right side view (the left side view being a mirror image) and FIG. 6 is a section view taken through the section line in FIG. 3. Riser 102 includes a front panel 104, a right side panel 106, a left side panel 108 and a top panel 110. Front panel 104 positions top panel 110 above display shelf 202. Top panel 110 includes a plurality of spaced apart through slots 112*a-f* that are in alignment with each other. Through slots 112*a-d* are substantially the same including having substantially the same widths and lengths 123. Slots 112*e* and 112*f*, however, have the same widths as slots 112*a-d*, but different lengths from slots 112*a-d*. Slots 112*e* and 112*f* are substantially the same including having substantially the same widths and lengths. In particular, slots 112*e* and 112*f* have lengths that are smaller than the lengths 123 of slots 112*a-d*.

In the embodiment illustrated in FIGS. 1-6, riser or box support 102 is made of a single sheet of formed or bent material, such as 16 GA mild steel. By forming the sheet material into the riser or box support as shown, the plurality of though slots 112*a-f* in top panel 110 are raised to a height that is equal to a height of front panel 104, right side panel 106 and left side panel 108. As illustrated in the FIG. 6 section view, riser 102 does not have a back panel in order to make the construction of and cost of riser 102 less expensive. However, it should be realized that in other embodiments, riser 102 could have a back panel. In addition, right side panel 106 and left side panel 108 include brackets that extend from the upper back edge of right side panel 106 and left side panel 108. These brackets are for mating with slots on a gondola upright as illustrated in FIG. 1. Also, the upper edges of right side panel 106 and left side panel 108 are not completely linear. Therefore, part of the upper edges of left side panel 106 and right side panel 108 are spaced apart from top panel 110.

Figure 7:
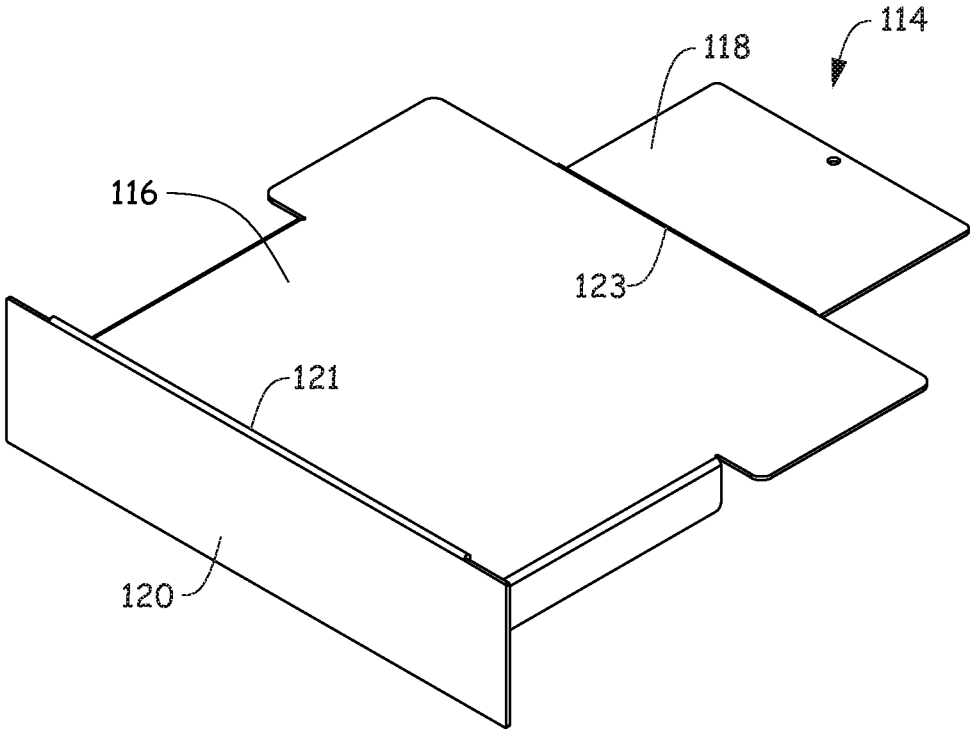
FIG. 7 is a perspective view of a paddle of the display riser assembly illustrated in FIG. 1.
Figure 8:
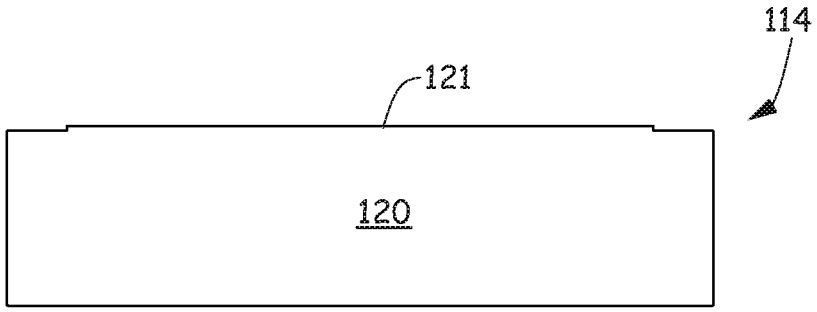
FIG. 8 is a front view of FIG. 7.
Figure 9:
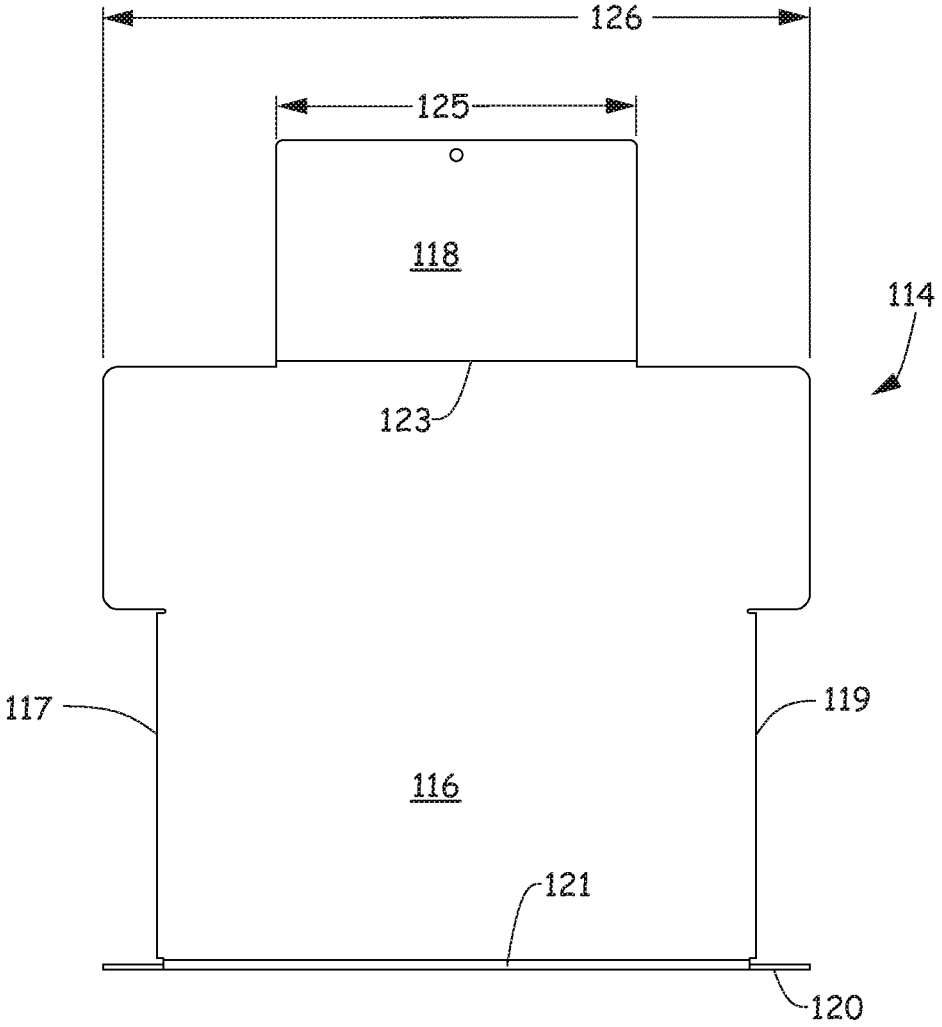
FIG. 9 is a top view of FIG. 7.
Figure 10:
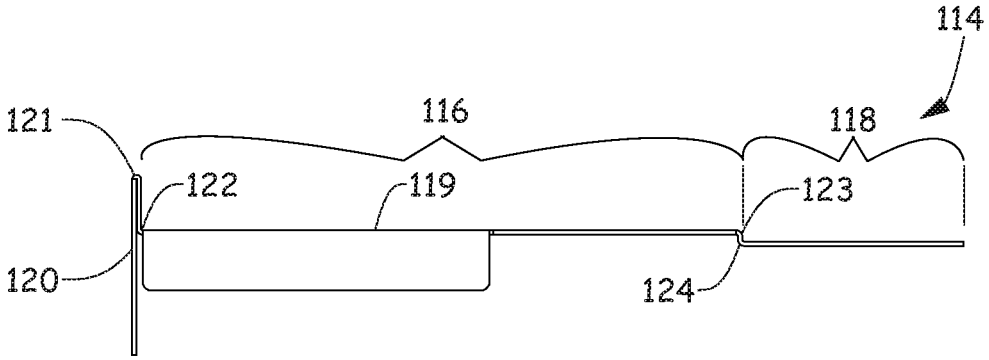
FIG. 10 is a right side view of FIG. 7.

FIG. 7 is a perspective view of one embodiment of a paddle 114 of display riser assembly 100. FIG. 8 is a front view, FIG. 9 is a top view and FIG. 10 is a right side view (the left side view being a mirror image) of paddle 114 of FIG. 7. Paddle 114 includes a planar display section 116 and a planar extension section 118. Display section 116 is a horizontally oriented planar portion of paddle 114 configured to support a floor cleaner sample product, for example. Extension section 118 extends outwardly and backwardly from display section 116 and is also a horizontally oriented planar portion. Extension section 118 is out of alignment with display section 116, but is substantially parallel with display section 116. Extension section 118 has a width 125 that is less than a width 126 of display section 116. This is because extension section 118 is configured to exert a force against the underside of top panel 110 so as to support display section 116, which is configured to support a floor cleaner sample product, for example.

In the embodiment illustrated in FIGS. 7-10, paddle 114 is made out of a single sheet of bent material, such as 16 GA mild steel, to form display section 116. Paddle 114 further includes a front panel 120, which has a vertically oriented planar portion that extends below display section 116, above display section 116 and across at least the greatest width 126 of display section 116. Front panel 120 is joined to display section 116 by a 90 degree upward bend 122 and includes a 180 degree downward bend 121. Front panel 120 is configured to support labels 127 (FIG. 1) for labeling the sample product being displayed on display section 116. Extension section 118 is joined to display section 116 by two 90 degree bends 123 and 124 so that extension section 118 is formed out of alignment with display section 116 but substantially parallel with display section 116. Two bends 117 and 119 form two L-shaped cantilever sections that strengthen display section 116. The L-shaped cantilever sections are located in front of riser 102 and extend below top panel 110 of riser 102 when installed in riser 102.

Figure 11:
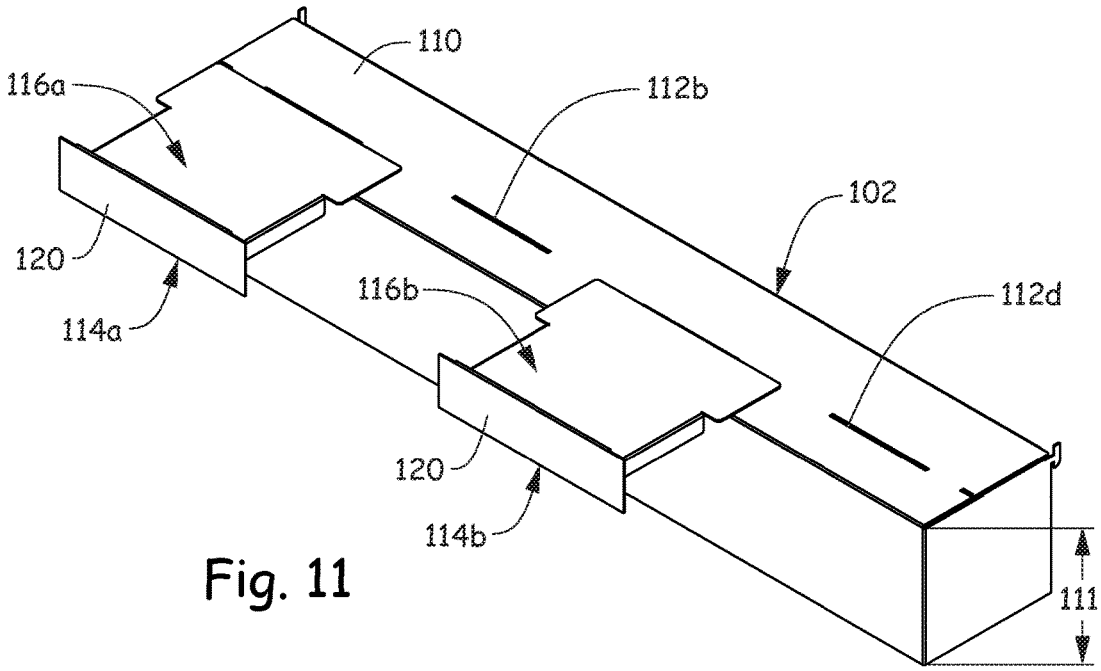
FIG. 11 is a perspective view of two of the paddles illustrated in FIG. 7 mounted to the riser in FIG. 2 to illustrate a portion of the display riser assembly shown in FIG. 1.

FIG. 11 is a perspective view of two of paddles 114 (labeled as 114*a* and 114*b*) mounted to riser or box support 102 to illustrate a portion of display riser assembly 100. As illustrated, paddles 114*a* and 114*b* are mounted to riser or box support 102 by inserting the single extension sections of each of paddles 114*a* and 114*b* in two of the plurality of slots 112*a*-112*d* in top panel 110 of riser 102 so that paddles 114*a* and 114*b* are toolles sly mounted to and cantilevered forward from top panel 110. Display sections 116*a* and 116*b* of paddles 114*a* and 114*b*, respectively, are located above top surface 201 of display shelf 200 at substantially the same height as a height 111 of top panel 110 located from top surface 201 of display shelf 200.

In the embodiment illustrated in FIG. 11, the extension sections of paddles 114*a* and 114*b* slide into two of slots 112*a*-112*d*, for example and as shown slots 112*a* and 112*c*. Therefore, slots 112*a*-112*d* have lengths 123 that are greater than the widths 125 of extension sections of paddles 114*a* and 114*b*. Also, while paddles 114*a* and 114*b* mate with slots 112*a* and 112*c* so that the paddles are positioned every other slot, it should be realized that to get this same configuration, paddles 114*a* and 114*b* could be positioned in slots 112*b* and 112*d* with the same effect.

A display riser assembly 100 in its entirety includes multiple risers or box supports 102 placed adjacent to each other and in alignment on a display shelf as illustrated in FIG. 1 as risers 102*a* and 102*b* and, in one embodiment, paddles 114*a-d* positioned in every other slot across the plurality of risers or box supports 102. In this way, a greater number of floor cleaners can be displayed on a display shelf than the number of floor cleaners that could be displayed without the display riser assembly 100. As illustrated in FIG. 1, a width between front panels 120 of each paddle 114*a-d* is less than a width of the base that defines the cleaning path on most of the floor cleaners. As such and as shown in FIG. 1, between each paddle 114*a-d* that is raised above the top surface of a display shelf is located a base of a floor cleaner with the upright portion extending between the paddles and upwardly past the paddles. On each display section of paddles 114*a-d* is located a base of a floor cleaner with the upright portion extending upwardly past the paddles. As shown, portions of the bases of floor cleaners that are located on top surface 201 of display shelf 200 are underneath the paddles above them to give a staggered look and also to be able to fit more floor cleaners on a shelf than if all the floor cleaners were placed on top surface 201 of display shelf 200 only.

Figure 12:
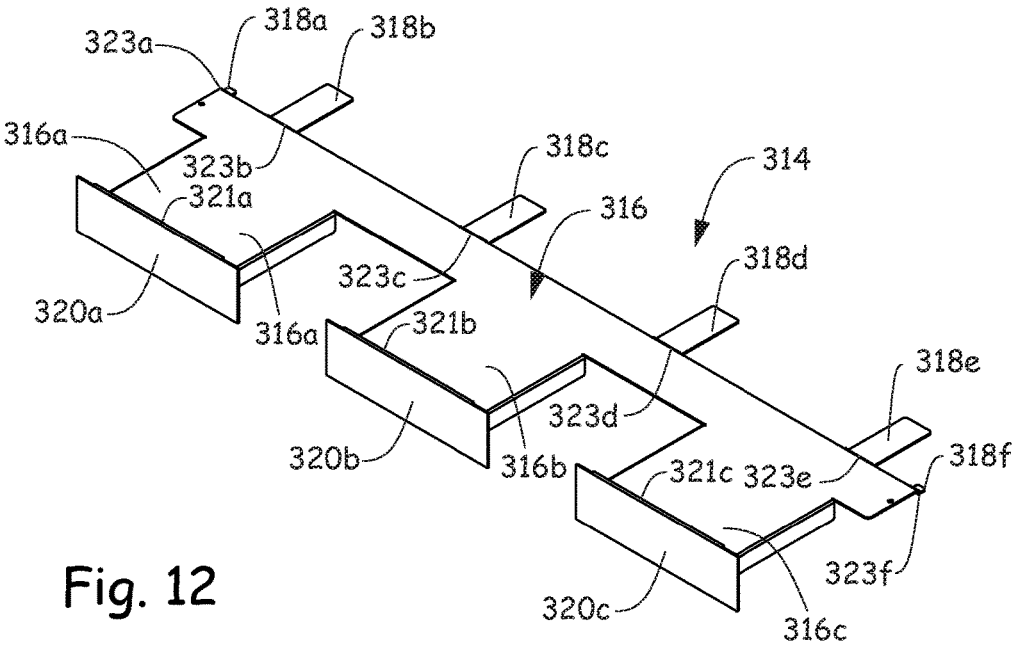
FIG. 12 is a perspective view of an alternative embodiment for a paddle of the display riser assembly illustrated in FIG. 1.
Figure 13:
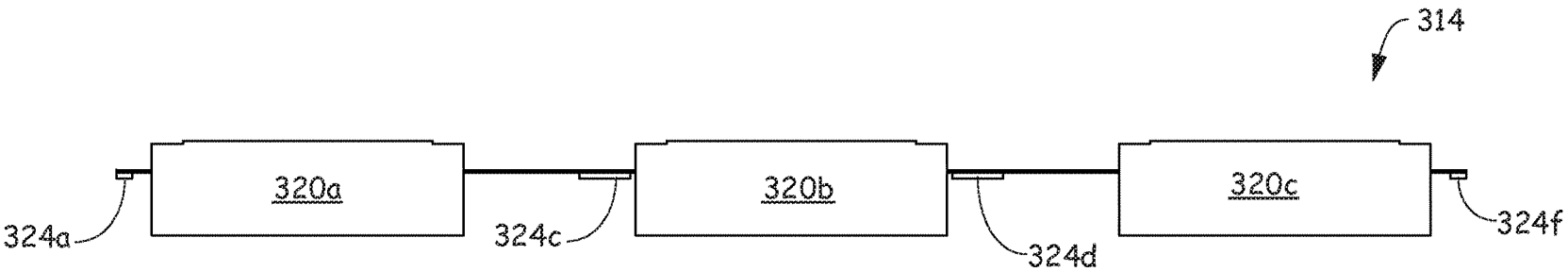
FIG. 13 is a front view of FIG. 12.
Figure 14:
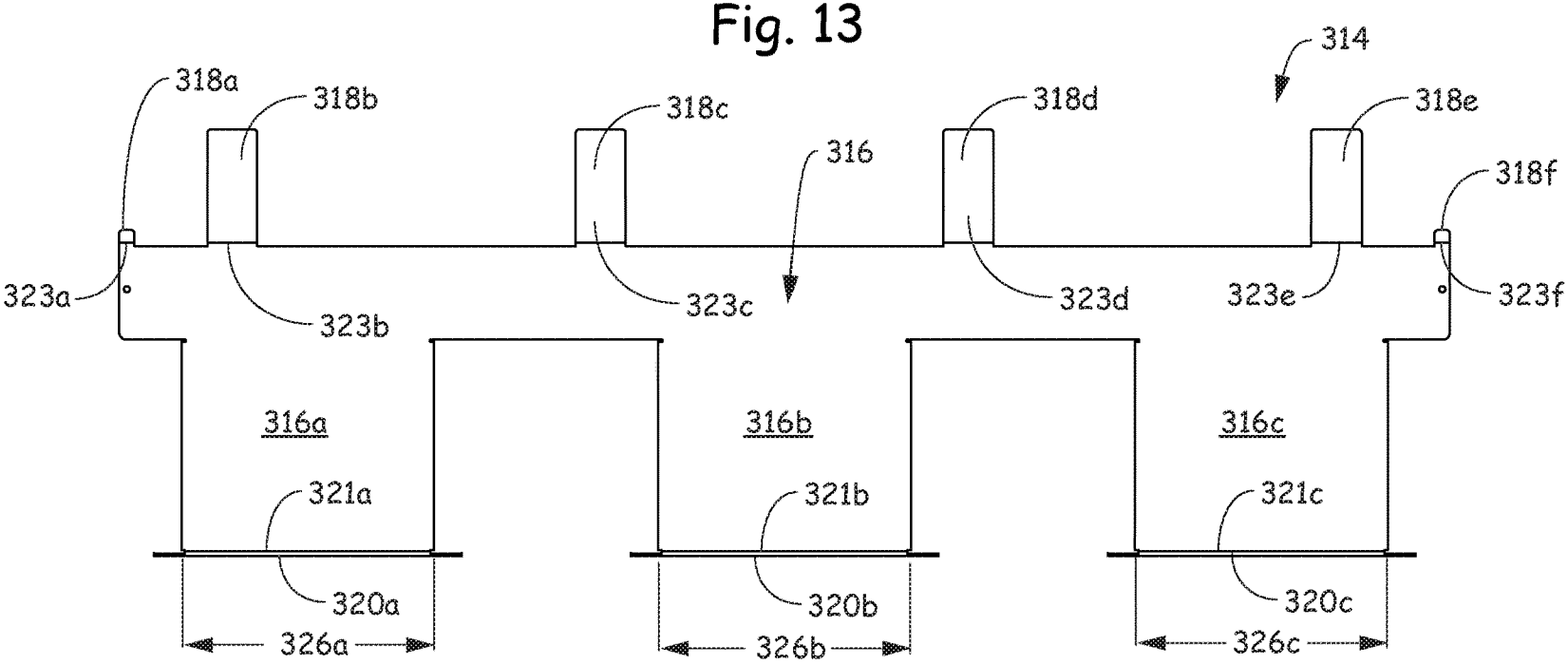
FIG. 14 is a top view of FIG. 12.
Figure 15:
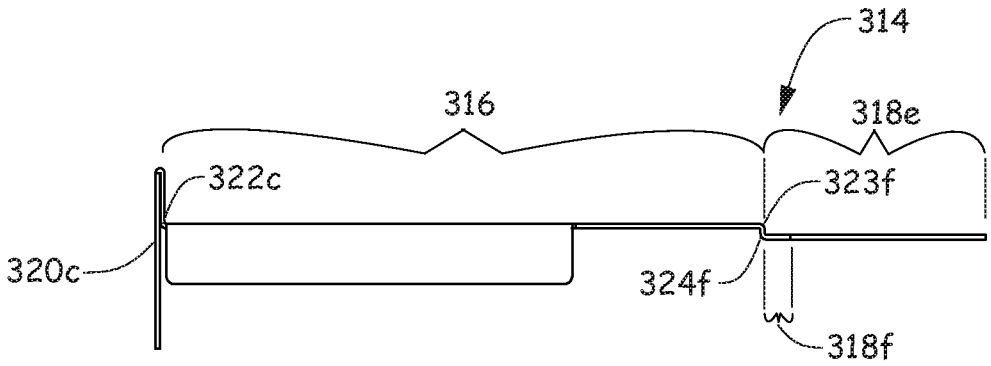
FIG. 15 is a right side view of FIG. 12.

FIG. 12 is a perspective view of another embodiment for a paddle 314 of display riser assembly 100. FIG. 13 is a front view, FIG. 14 is a top view and FIG. 15 is a right side view (the left side view being a mirror image) of paddle 314 of FIG. 12. Paddle 314 includes planar display section 316 having a plurality of planar portions 316*a*, 316*b* and 316*c* for supporting the base of a floor cleaner and a plurality of planar extension sections 318*a-f*. Not all extension sections 318*a-f* are substantially the same. In the embodiment illustrated in FIGS. 12-15, the right most extension section 318*a* and the left most extension section 318*f* are smaller and shorter than extension sections 318*b-e*. Display section 316 is a horizontally oriented planar portion of a paddle 314 where each of the plurality of portions 316*a*, 316 and 316*c* of display section 316 is configured to support a floor cleaner sample product, for example. Extension sections 318*a-f* extend outwardly and backwardly from display section 316 and are also horizontally oriented planar portions. Extension sections 318*a-f* are out of alignment with display section 316, but are substantially parallel with display section 316 and therefore with portions 316*a-c* of display section 316.

In the embodiment illustrated in FIGS. 12-15, paddle 314 is made out of a single sheet of material, such as 16 GA mild steel. To form paddle 314, fronts 320*a*, 320*b* and 320*c*, which are vertically oriented planar portions that extend below display section 316, above display section 316 and across at least the greatest width 326*a-c* of each display portion 316*a-c* are formed by bending the single sheet of material. Front panels 320*a-c* are each joined to display portions 316*a-c*, respectively, of display section 316 by a 90 degree upward bend (of which only 90 degree bend 322*c* is illustrated in FIG. 15) and includes a 180 degree bend 321*a-c*. Each extension section 318*a-f* is joined to display section 316 by two 90 degree bends (of which only 90 degree bends 323*a-f*, 324*a*, 324*c*, 324*d* and 324*f* are illustrated in FIGS. 12, 13, 14 and 15) so that each extension section 318*a-f* is formed out of alignment with display section 316 but substantially parallel with display section 316.

Figure 16:
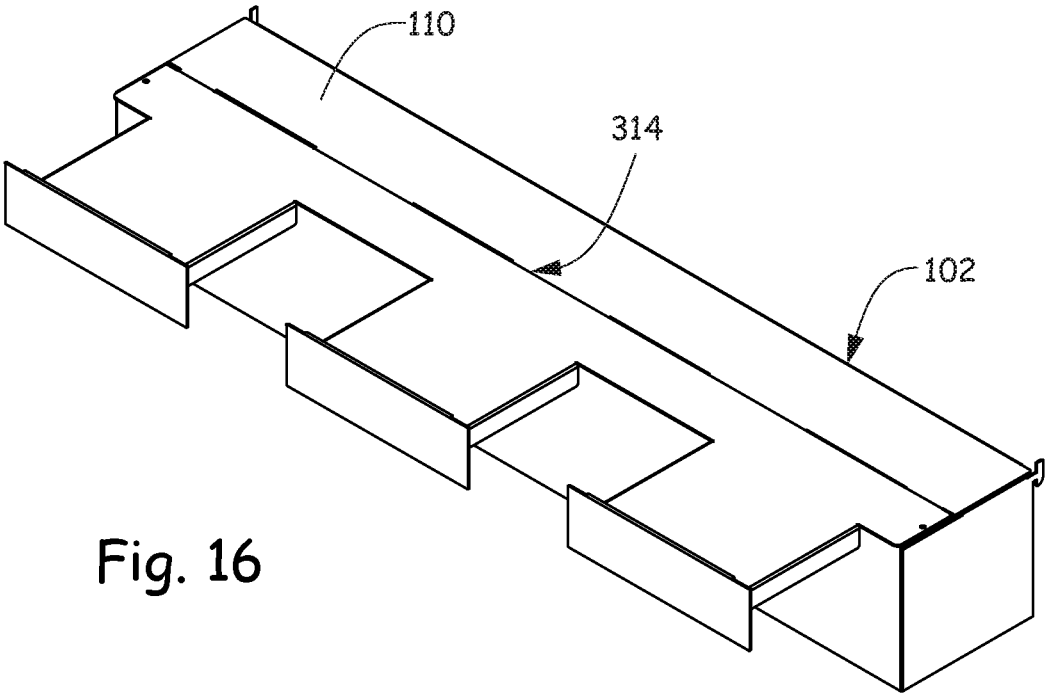
FIG. 16 is a perspective view of the paddle illustrated in FIG. 12 mounted to the riser in FIG. 2 to illustrate a portion of the display riser assembly shown in FIG. 1.

FIG. 16 is a perspective view of paddle 314 mounted to riser or box support 102 to illustrate a portion of an alternative embodiment of the display riser assembly 100. As illustrated, paddle 314 is mounted to riser or box support 102 by inserting the extension sections 318*b-e* of paddle 314 in each of the plurality of slots 112*a*-112*d* in top panel 110 of riser 102 and extension sections 318*a* and 318*f* are inserted into slots 112*e* and 112*f*. In the embodiment illustrated in FIG. 16, the extension sections 318*b-e* of paddle 314 slide into slots 112*a*-112*d* and extension sections 318*a* and 318*f* slide into slots 112*e* and 112*f*. Therefore, slots 112*a*-112*d* have widths that are greater than the widths of extension sections 318*b-e* of paddle 314 and slots 112*e* and 112*f* have widths that are greater than the widths of extension sections 318*a* and 318*f*.

A display riser assembly 100 in its entirety includes multiple risers or box supports 102 placed adjacent to each other and in alignment on a display shelf as illustrated in FIG. 1 and, in one embodiment, a paddle 314 is mounted to each riser. In this way, a greater number of floor cleaners can be placed on a display shelf than the number that could be displayed without the display riser assembly 100. As illustrated in FIG. 1, a width between the front panels 320*a-c* of each portion 316*a-c* is less than a width of the base that defines the cleaning path on most of the floor cleaners. As such and as shown in FIG. 1, between each portion 316*a-c* that is raised above the top surface of a display shelf is located a base of a floor cleaner with the upright portion extended between the portions 316*a-c* and upwardly past the portions. On each portion 316*a-c* of a paddle 314 is located a base of a floor cleaner with the upright portion extending upwardly past the paddles. As shown, portions of the bases of floor cleaners that are located on a top surface of a display shelf are underneath the portions above them to give this staggered look and also be able to fit more floor cleaners on a shelf then if all the floor cleaners were placed on the top surface of the display shelf only.

Although elements have been shown or described as separate embodiments above, portions of each embodiment may be combined with all or part of other embodiments described above.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A display riser assembly comprising:

at least one riser configured to rest on a back portion of a top surface of a display shelf, the at least one riser including a top panel and a front panel that positions the top panel above the display shelf, the top panel including a plurality of spaced apart through slots; and at least one paddle made of a single sheet of material and being mounted to the at least one riser, the at least one paddle including at least one planar display section and at least one planar extension section that extends backward from the at least one planar display section and is joined to the at least one planar display section by a first bend in the single sheet of material and a second bend in the single sheet of material so that the at least one planar extension section is substantially parallel with the at least one display section; and wherein the at least one planar extension section of the at least one paddle is inserted into one of the plurality of spaced apart slots so that the display section is toollessly cantilevered from the riser and is located above the top surface of the display shelf by a height; and wherein the at least one riser comprises a plurality of risers located side end to side end along the display shelf and the at least one paddle comprises a plurality of paddles positioned along the plurality of risers so that each paddle is inserted into every other through slot located on each riser.

2. The display riser assembly of claim 1, wherein the first bend comprises a 90 degree bend and the second bend comprises a 90 degree bend.

3. The display riser assembly of claim 1, wherein the at least one paddle comprises a plurality of paddles, wherein each paddle includes a single extension section that is inserted into one of the plurality of spaced apart through slots.

4. The display riser assembly of claim 3, wherein each of the plurality of paddles are inserted into every other spaced apart through slot.

5. The display riser assembly of claim 1, wherein the at least one paddle comprises a single paddle having a plurality of planar extension sections that are inserted into each of the plurality of spaced apart through slots.

6. The display riser assembly of claim 1, wherein the at least one paddle further comprises at least one front panel that extends across a width of the at least one display section and is configured to support labels for labeling the product being displayed on the at least one display section.

7. The display riser assembly of claim 1, wherein the at least one riser comprises a single sheet of material bent to form the top panel and the front panel.

8. A display riser assembly comprising:

at least one box support configured to rest on a back portion of a top surface of a display shelf and including a top panel, a front panel and two side panels located on either ends of the top panel and the front panel, wherein the top panel includes a plurality of spaced apart through slots that extend from the top surface of the top panel to a bottom surface of the top panel; and at least one paddle including at least one planar display section and at least one planar extension section that extends backwardly from the at least one display section, wherein the at least one planar extension section is inserted into one of the plurality of through slots such that a top surface of the at least one planar extension section faces the bottom surface of the top panel of the riser and so that the at least one display section is cantilevered forward from the box support and located above the top surface of the display shelf by a height; and wherein the at least one box support comprises a plurality of box supports located side panel to side panel along the display shelf and the at least one paddle comprises a plurality of paddles positioned along the plurality of box supports so that each paddle is inserted into every other through slot located on each box support.

9. The display riser assembly of claim 8, wherein the at least one planar extension section is joined to the at least one planar display section by a first approximate 90 degree bend and a second approximate 90 degree bend so that the at least one planar extension section is substantially parallel with the at least one display section and wherein the at least one planar extension section is inserted in one of the plurality of through slots so that the at least one planar display section is substantially parallel with the top surface of the display shelf.

10. The display riser assembly of claim 8, wherein the at least one paddle comprises a plurality of paddles, wherein each paddle includes a single extension section that is inserted into one of the plurality of spaced apart through slots.

11. The display riser assembly of claim 10, wherein each of the plurality of paddles are located in every other spaced apart through slot.

12. The display riser assembly of claim 8, wherein the at least one paddle comprises a single paddle having a plurality of planar extension sections that are inserted into each of the plurality of spaced apart through slots.

13. The display riser assembly of claim 8, wherein the at least one box support comprises a single sheet of material bent to form the top panel, the front panel and the two side panels and wherein the at least one paddle comprises a single sheet of material bent to form the at least one planar display section and the at least one planar extension section.

14. A method of displaying products on a display shelf, the method comprising:

resting at least one riser on a back portion of a top surface of a display shelf, the at least one riser including a top panel having a plurality of spaced apart slots that extend from a top surface of the top panel to a bottom surface of the top panel and a front panel that positions the top panel above the display shelf; wherein resting at least one riser on the back portion of the top surface of the display shelf comprises resting a plurality of risers on the back portion of the top surface of the display shelf so that ends of each riser are adjacent to each other;

inserting at least one planar extension section of at least one paddle into one of the plurality of spaced apart slots in the top panel so that a top surface of the at least one planar extension section faces the bottom surface of the top panel of the riser, the at least one paddle further including at least one planar display section that is formed integrally with the at least one planar extension section and extends outwardly from the at least one riser and is located a distance above the top surface of the display shelf; and displaying products on the top surface of the display shelf adjacent to and partially underneath the at least one planar display section and displaying a product on the at least one planar display section.

15. The method of claim 14, wherein inserting the at least one planar extension section of the at least one paddle into one of the plurality of spaced apart slots in the top panel comprises inserting a single planar extension section of a single paddle into one of the plurality of spaced apart slots and inserting another single planar extension section of another single paddle into another one of the plurality of spaced apart slots.

16. The method of claim 14, wherein inserting the at least one planar extension section of the at least one paddle into one of the plurality of spaced apart slots in the top panel comprises inserting a plurality of planar extension sections of a single paddle into the plurality of spaced apart slots.

* * * * *